US007493667B2

(12) United States Patent
Ferko, III

(10) Patent No.: US 7,493,667 B2
(45) Date of Patent: Feb. 24, 2009

(54) FOLDABLE MEDICAL BED

(76) Inventor: Joseph G. Ferko, III, 412 Park Creek Rd., Pasadena, MD (US) 21122

( * ) Notice: Subject to any disclaimer, the term of this patent is extended or adjusted under 35 U.S.C. 154(b) by 231 days.

(21) Appl. No.: 11/444,533

(22) Filed: Jun. 1, 2006

(65) Prior Publication Data

US 2007/0277317 A1 Dec. 6, 2007

(51) Int. Cl.
*A47C 17/00* (2006.01)
*A47C 19/04* (2006.01)

(52) U.S. Cl. ..... 5/110; 5/111; 5/620; 297/354.13; 297/55

(58) Field of Classification Search ..... 5/620, 5/618, 110, 111, 625, 626, 174, 179, 168
See application file for complete search history.

(56) References Cited

U.S. PATENT DOCUMENTS

| | | | | |
|---|---|---|---|---|
| 972,537 | A | 10/1910 | Jeffcott | |
| 1,541,105 | A | 6/1925 | Broome | |
| 2,678,085 | A * | 5/1954 | De Minno | 297/383 |
| 3,077,612 | A | 2/1963 | Sevcik | |
| 3,295,149 | A * | 1/1967 | Hall | 5/174 |
| 3,456,269 | A | 7/1969 | Goodman | |
| 3,602,926 | A * | 9/1971 | Marini et al. | 5/111 |
| 3,742,529 | A * | 7/1973 | Stehlik | 5/118 |
| 3,987,504 | A * | 10/1976 | Fox | 5/111 |
| 5,160,185 | A * | 11/1992 | Stang | 297/377 |
| 6,035,468 | A | 3/2000 | Lee | |
| 6,151,730 | A | 11/2000 | Weston | |
| 6,253,396 | B1 | 7/2001 | Weston | |
| 6,735,797 | B1 | 5/2004 | Long et al. | |
| 7,103,927 | B2 * | 9/2006 | Holub | 5/111 |
| 2004/0055085 | A1 * | 3/2004 | Boscaro | 5/110 |
| 2004/0055088 | A1 * | 3/2004 | Heimbrock et al. | 5/618 |

* cited by examiner

*Primary Examiner*—Patricia L Engle
*Assistant Examiner*—Alyson M Merlino
(74) *Attorney, Agent, or Firm*—Roylance, Abrams, Berdo & Goodman, L.L.P.

(57) ABSTRACT

A folding bed or cot particularly for use as a portable medical bed includes a center base portion connected to a support frame. An adjustable frame has first and second sections that can pivot between a horizontal section and an inclined position. A webbing material or fabric is attached to the adjustable frame and the center base portion of the main support frame to support the patient. The webbing is attached to the side edges of the center base portion to form a planar center portion.

17 Claims, 5 Drawing Sheets

FOLDABLE MEDICAL BED

FIELD OF THE INVENTION

The present invention is directed to a foldable medical bed. More particularly, the invention is directed to a foldable medical bed that can be easily transported and includes adjustable head and foot sections.

BACKGROUND OF THE INVENTION

Natural disasters often result in large numbers of displaced and homeless civilians. Typically, the displaced civilians are forced to take refuge in tents, camps or public buildings that do not have adequate sleeping facilities. In these situations, it is necessary to supply large numbers of portable cots or beds. Many of the designs of the folding cots are unstable and difficult to assemble.

Various designs have been proposed for folding cots that improve on the traditional army-style folding cot. Examples of such designs are disclosed in U.S. Pat. Nos. 6,253,396 and 6,151,730 to Weston. The cots include an outer supporting frame and an inner frame that can be folded in relation to the outer frame to elevate the head portion and the foot portion.

While the prior foldable beds and cots have been generally suitable for the intended purpose, there is a continuing need in the industry for improvements to the prior beds and cots.

SUMMARY OF THE INVENTION

The present invention is directed to a folding bed and particularly a folding medical bed. The invention is also directed to a folding medical bed that is easily folded for transporting and storage.

Accordingly, one aspect of the invention is to provide a folding medical bed that is stable for use by an individual while being sufficiently strong for normal use. The folding medical bed has a plurality of folding legs that can be folded outwardly to provide a stable support on various uneven terrains.

Another aspect of the invention is to provide a foldable medical bed having a stable, immovable center portion that bears a substantial portion of the patient's weight when sitting in an upright position. The folding medical bed has a pivotally mounted first head section that can pivot along a first edge of the center portion to elevate the upper body of the patient.

A further aspect of the invention is to provide a foldable medical bed having a center frame having a longitudinal length to define a stable immovable portion of the bedding support surface. The bedding support surface which is typically a fabric is attached to the center frame and to adjustable head and foot sections.

Another aspect of the invention is to provide a folding medical bed having a folding main frame having supporting legs and a second frame that is pivotally mounted on the main frame. A fabric is attached to the second frame to support the patient. In one embodiment, the second frame is mounted to the main frame to surround the main frame so that the fabric overlies the main frame.

Still another aspect of the invention is to provide a folding medical bed having an adjustable foot section and an adjustable head section pivotally connected to a main support frame.

These and other aspects of the invention are basically attained by providing a folding bed comprising a center base which has a first support member and a second support member. The first and second support members have a longitudinal top edge. A main support frame has a first section pivotally coupled to a first end of the first and second support members and a second section pivotally connected to a second end of the first and second support members about the pivot points. An adjustable frame has a first section pivotally connected to the first section of the main support frame and a second section pivotally connected to the second section of the main support frame about the second pivot points. A flexible support web is attached to each of the first and second sections of the adjustable frame and to the longitudinal top edge of the first and second support members. The first and second support members form a planar center portion of the web having a width extending between the longitudinal top edges and a length extending along the longitudinal top edges of the first and second support members.

The aspects of the invention are further attained by providing a folding bed comprising a center base which has a first planar support member and second planar support member. Each support member has a longitudinal top edge and a longitudinal bottom having a dimension for supporting the center base in an upright position. The first and second support members are connected together by a brace member. A main support frame assembly includes a first section having one end pivotally coupled to a first side edge of the first and second planar support members, and a second section having one end pivotally coupled to a second side edge of the first and second planar support members. The first and second sections are pivotable between a horizontal position with respect to the center base to a downwardly folded position. An adjustable frame assembly has a first section pivotally connected to the first section of the support frame at a pivot axis spaced outwardly from the pivot axis of the first section of the support frame. A second section is pivotally connected to the second section of the support frame at a pivot axis spaced outwardly from the pivot axis of the second section of the support frame. A flexible support web is attached to the longitudinal top edge of each of the first and second planar support members to form a planar center support portion of the web extending between the planar support members and having a length substantially equal to a length of the planar support members. The web is attached to the first section and the second section of the adjustable frame.

The aspects of the invention are also attained by providing a folding bed comprising a center base having a first planar support member and a second planar support member connected together by a brace. Each support member has a longitudinal top edge and bottom with a dimension to support the center base in an upright position. Each support member has a first side edge and a second side edge. A main support frame has a first section having a first end pivotally connected to the first and second planar support members at the first side edge and is pivotable about a first pivot point in a downward direction. A second section has a first end pivotally connected to the first and second planar support members at the second side edge and is pivotable in a downward direction about a first pivot point. An adjustable frame assembly has a first section with a first end pivotally coupled to the first section of the main support frame at a pivot axis spaced outwardly from a pivot axis of the first section of the main support frame. A second section has a first end pivotally connected to the second section of the main support frame at a pivot axis spaced outwardly from a pivot axis of the second section of the main support frame. A pair of support arms has a first end coupled to a second end of the first and second sections of the adjustable frame and a second end portion engaging the main frame to support the first and second sections of the adjustable frame at a selected angle with respect to the main frame. A flexible support web is attached to the longitudinal top edge of each first and second planar support members to form a planar center support portion of the web extending between the planar support members and having a length substantially equal to a length of the planar support member. The web is attached to the second end of the first and second sections of the adjustable frame.

These and other aspects and features of the invention will become apparent from the following detailed description of the invention which in conjunction with the annexed drawings, disclose various embodiments of the invention.

BRIEF DESCRIPTION OF THE DRAWINGS

The following is a brief description of the drawings, in which.

DETAILED DESCRIPTION OF THE INVENTION

The present invention is directed to a folding bed or cot that can be folded to a compact form for ease of storage and transporting. More particularly, the invention is directed to a folding bed that is suitable for emergency medical use.

Figure 1:
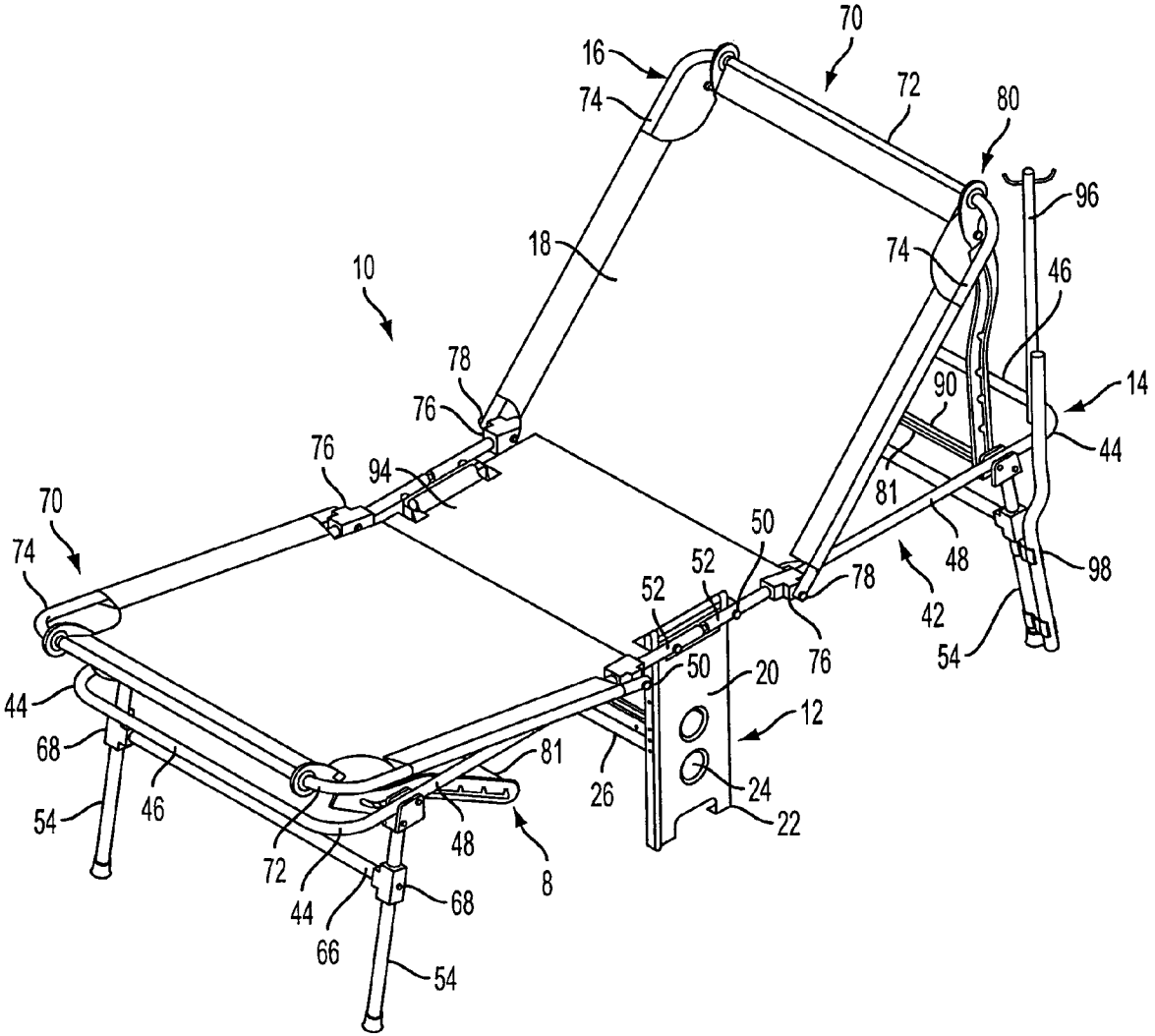
FIG. 1 is a perspective view of the folding medical bed in an operating position and showing the head section in an elevated position.

Referring to the drawings, the folding bed 10 of the invention includes a center base 12, a main support frame 14, and an adjustable frame 16. As shown in FIG. 1, the adjustable frame 16 is adjustable with respect to the center base 12 and with respect to the main support frame 14. A flexible webbing material 18 is attached to the center base 12 and the adjustable frame 16 to support a patient. Preferably, the flexible swelling material is a continuous material that is attached to the center base 12 and the adjustable frame 16.

Figure 4:
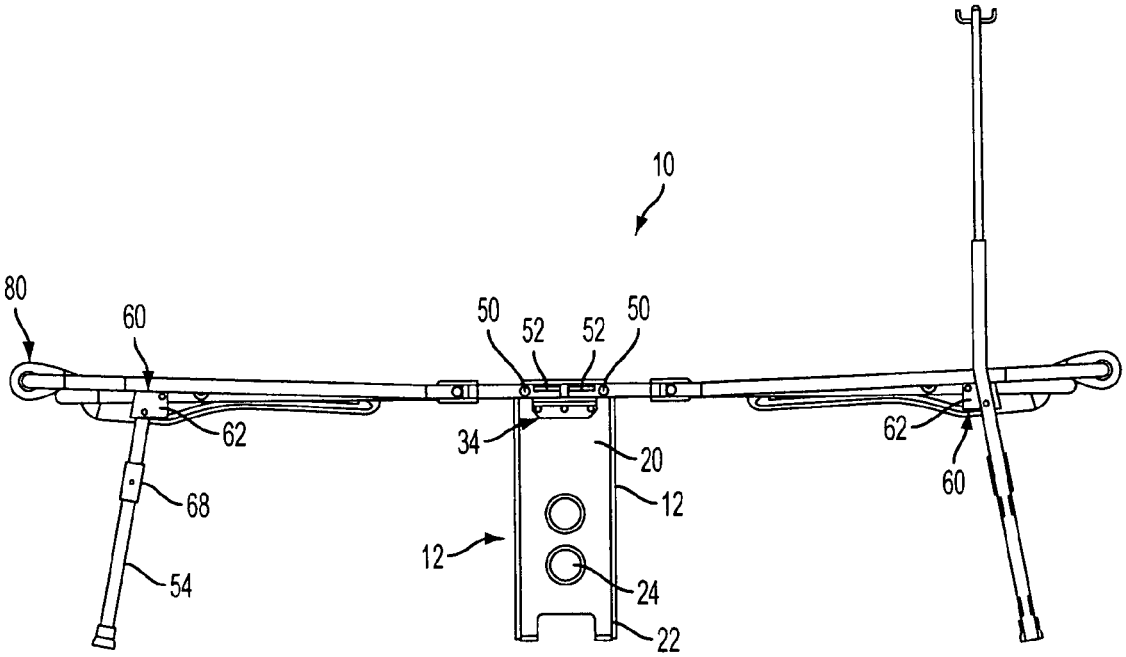
FIG. 4 is a side view of the foldable medical bed of FIG. 2.
Figure 5:
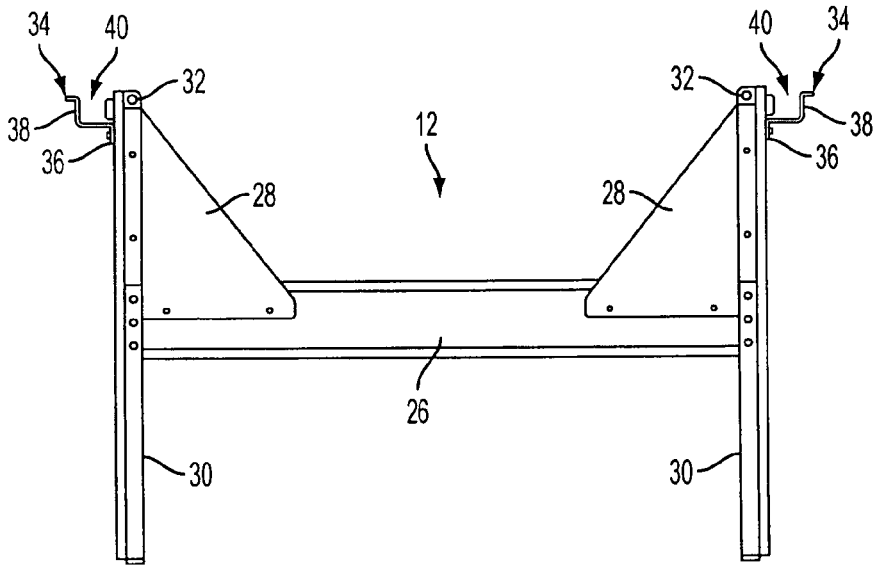
FIG. 5 is an end side view of the center support frame of the foldable medical bed.

As shown in FIGS. 4 and 5, the center base 12 forms a center support structure for the folding bed 10 and has a width defining the width of the bed 10 and a length defining a center portion of the support surface of the bed. The center base 12 includes opposite end panels 20 having a generally rectangular configuration and forming first and second support members. The height of the end panels 20 define the height of the bed and the width defines the length of the center portion of the support surface of the bed. The bottom end of the end panels 20 are formed with a pair of spaced apart legs 22 to stabilize the center portion of the bed. Cut-outs 24 are provided with folded or stamped edges to reduce weight and formed with flanges to increase the strength of the end panels 20. The end panels are connected together by a pair of rails 26 connected to the opposite side edges of the end panels 20. Corner braces 28 are attached to the end surfaces of the end panels 20 and the rails 26 to stabilize the center base 12. Typically, the center base 12 is made of metal, although other materials can also be used.

The end panels 20 of the base 12 are typically made of sheet metal having folded side edges 30 to strengthen the end panels and to provide coupling surfaces for the rails and the corner braces 28. The top end of each end panel includes a rod 32 extending between the side edges 30 for attaching to the web as discussed hereinafter in greater detail. The side edges 30 are folded from the end panel along a fold line and are integrally formed with the end panel. As shown in FIG. 5, the rods 32 are oriented adjacent the top edge and have a length corresponding to the width of the center base. Preferably, the rods 32 are fixed to the side edges.

The outer face of each end panel 20 includes a bracket 34 having a generally L-shape and having a first leg 36 attached to the end panel 20 and a second leg 38 forming an upwardly open recess 40. As shown in FIG. 4, the bracket 34 is oriented in the center portion of the end panel parallel to a top edge and has a length to extend a substantial width of the end panel while having its longitudinal ends spaced inwardly from the side edges.

Figure 8:
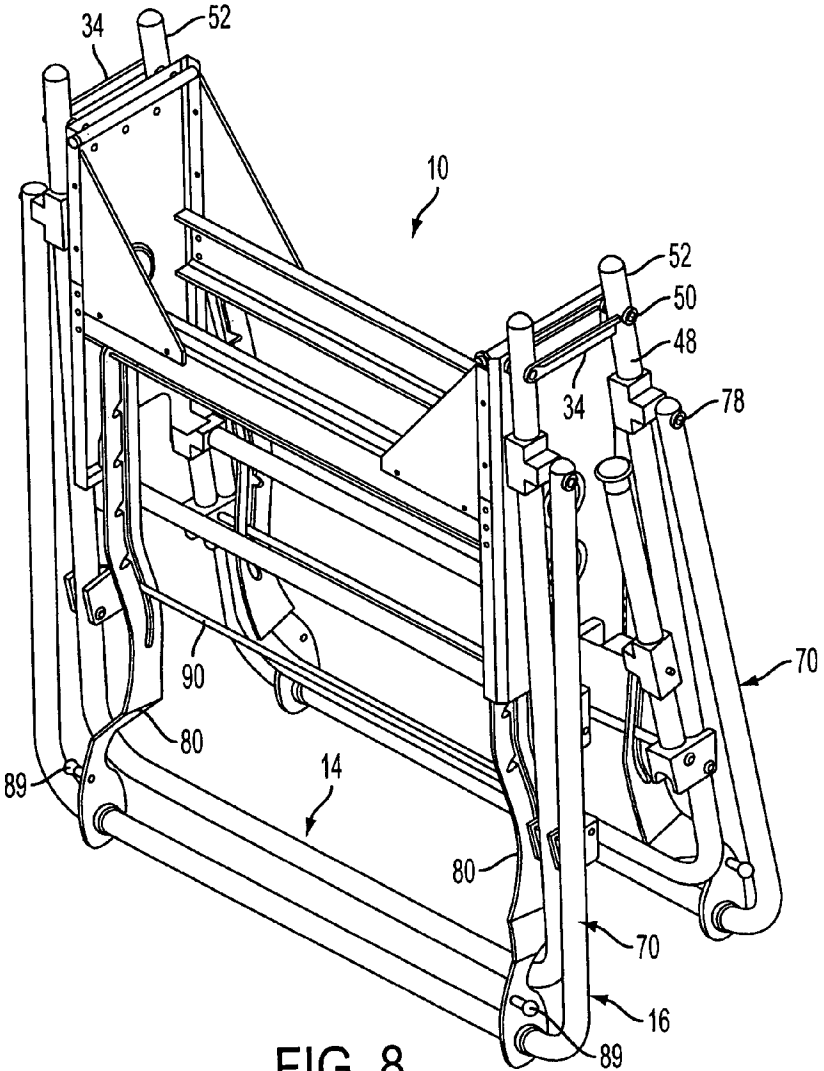
FIG. 8 is a perspective view of the folding medical bed in the folded position.

Main frame 14 includes two symmetrical sections 42 each having a foldable frame 44 formed from tubing having a generally U-shape. The frame 44 is formed by an end section 46 and a pair of parallel arms 48 extending from the end section 46. The ends of the arms 48 are pivotally connected to a respective end panel as shown in FIG. 1 by a pivot pin 50 extending through the arms and the panel. As shown in FIG. 4, the arms 48 are pivotally connected by a pivot pin 50 at a pivot point adjacent the side edges of the end panels and between the ends of the bracket 34 and the side edges. The pivot pin 50 is positioned on end panels 20 aligned with the bracket 34 and the recess 40 of the bracket 34 so that the adjustable frame 44 can pivot between a horizontal position shown in FIG. 1 and a folded position shown in FIGS. 7 and 8 where the arms 48 lie substantially parallel to the side edge of the end panels 20. The pivot pin 50 passes through each respective arm 48 at a point spaced from the end of the arm to define an end portion 52. Each end portion 52 has a length so that the axial ends of the arm 48 are closely spaced to each other when in the horizontal position shown in FIG. 1. The end portions are received in the recess 40 of the bracket 34 to limit the upward pivoting movement of the arm 48 beyond a horizontal position with respect to the center base 12. The bracket 34 defines a stop member to limit pivotal movement of the arms 48 and to limit flexing and side to side movement of the arms with respect to the center base 12 when the end portions 52 are received in the recess 40 of the bracket 34.

Figure 7:
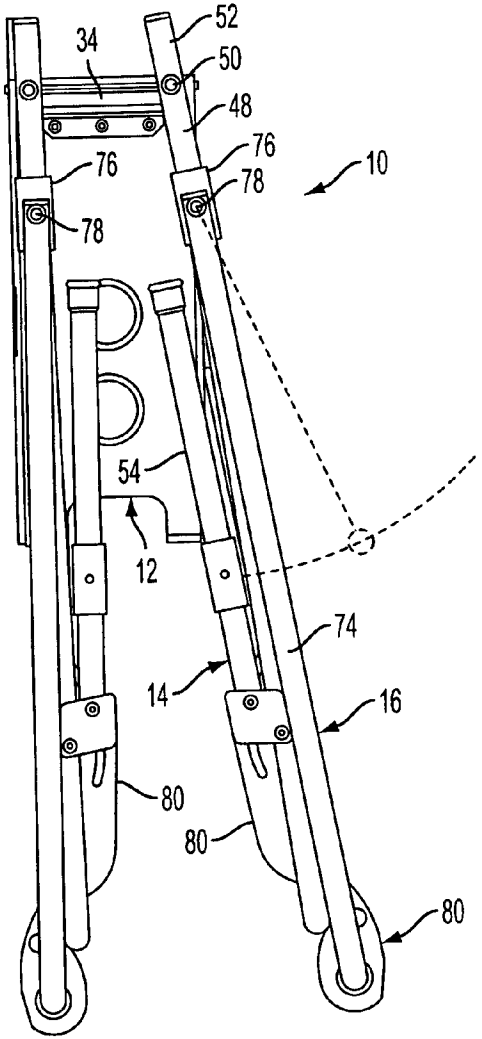
FIG. 7 is an end view of the foldable medical bed of FIG. 2 in a folded position.

Each main frame section 44 includes folding legs 54 pivotally connected to the arms 48. The legs 54 are pivotally connected to the arms 48. The legs 54 have a ground engaging bottom end 56 with a non-skid tip and a top end 58 connected to a hinge member 60. The hinge 60 has a body with a hole on a bottom side for receiving the top end 58 of the leg 54. A pair of flanges 62 extend upwardly forming a U-shaped groove for receiving the respective arm 48 of the frame 42. Hinge 60 is connected to a respective arm 48 by a hinge pin 64 that extends through the flanges 62 and the arm 48 at an end of the arm opposite pivot pin 50. The hinge 60 is constructed to pivot legs 54 from a folded position shown in FIGS. 7 and 8 to an upright position as shown in FIG. 1 where the legs 54 are oriented slightly forward with respect to the center base 12 to stabilize the assembly. As shown in FIG. 7, the legs 54 fold substantially parallel to the arms 48 of the frame 44. The arms 48 of the frame sections 44 can be folded downwardly with respect to the center base 12 so that end portions 52 of arms 48 pivot upwardly from the recess 40 of bracket 34.

A cross brace 66 extends between the legs 54 to provide increased strength and stability. In the embodiment shown, the ends of the cross brace 66 are coupled to a bracket 68 which is attached to a respective leg 54.

The adjustable frame 16 is formed as two symmetrical sections pivotally connected to the arms 48 of the sections of the main frame 14. Each section 70 of the adjustable frame 16 includes an end member 72 and two parallel legs 74. The axial ends of legs 74 are pivotally connected to a bracket 76 by a pivot pin 78. As shown in FIG. 1, the bracket 76 is spaced outwardly from the pivot pin 50 connecting the section 42 of the main frame to the center base 12. Each section 70 of the adjustable frame 16 can be moved independently from a horizontal position to an inclined position shown in FIG. 1. Preferably, each section 70 has a dimension slightly greater than the dimensions of each frame 44 of main frame 14 to surround the respective main frame 44 when the adjustable frame section 70 is in the horizontal position. In this manner, the web 18 attached to the section 70 of the covers the main frame to eliminate or cover a gap between the main frame and the adjustable frame.

Figure 6:
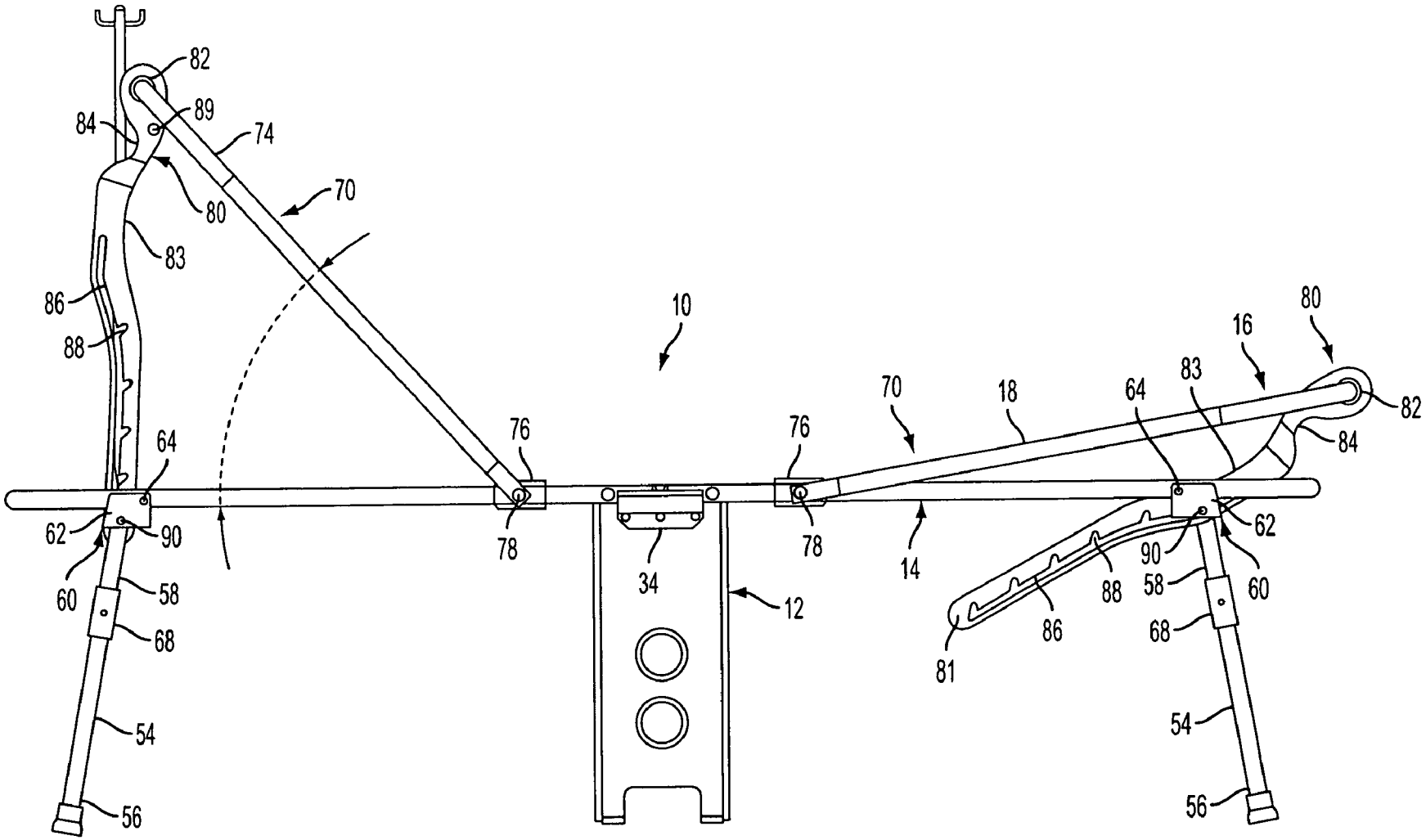
FIG. 6 is a side view of the foldable medical bed of FIG. 2 showing the head and foot sections in an elevated position.

The position of each section 70 of the adjustable frame 16 is provided by an adjustment arm 80. Preferably, two adjustment arms 80 are pivotally connected to the end section 72. In the embodiment shown, adjustment arm 80 has an aperture 82 at a top end through which the end section 72 is passed to allow the pivotal movement of the adjustment arm 80 with respect to the end section 72. The bottom ends of the adjustment arms 80 are coupled together by a cross brace or rod 81. Adjustment arm 80 includes a recessed portion 84 and an elongated slot 86. As shown in FIG. 6, slot 86 includes a plurality of notches that are angled with respect to the longitudinal axis of the slot 86. A rod 90 passes through the slot 86 of the adjustment arms 80 which is attached to the hinge 60. As shown in FIG. 6, the notches 88 engage and hook onto the rod 90 to adjust the incline of the section 70 of the adjustable frame with respect to the main frame 14. The recessed portion 84 in the adjustment arm contacts the end section 46 of frame 44 of the main frame 14 to support the section 70 of the adjustable frame 16 in a horizontal position substantially parallel to the arms 48 of the main frame 14. The rod 81 cooperating with the slot 86 and the recessed portion 84 engaging the end section stabilize the section 70 and support the section on the main frame.

Figure 2:
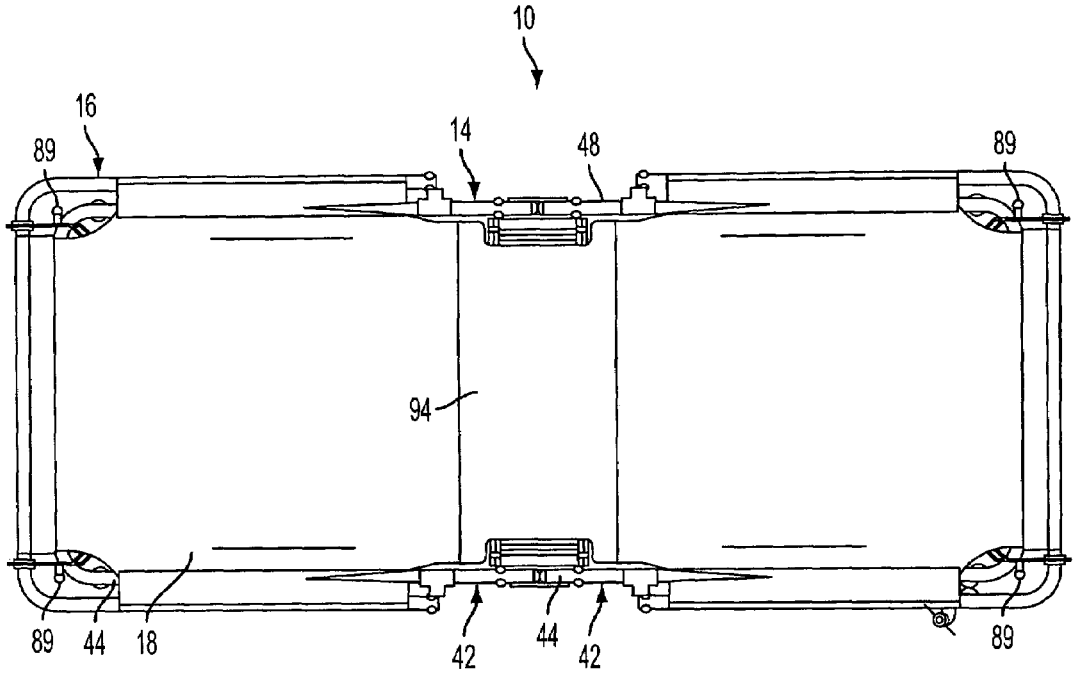
FIG. 2 is a top plan view of the foldable medical bed of FIG. 1 showing the foot and head sections in the horizontal position.
Figure 3:
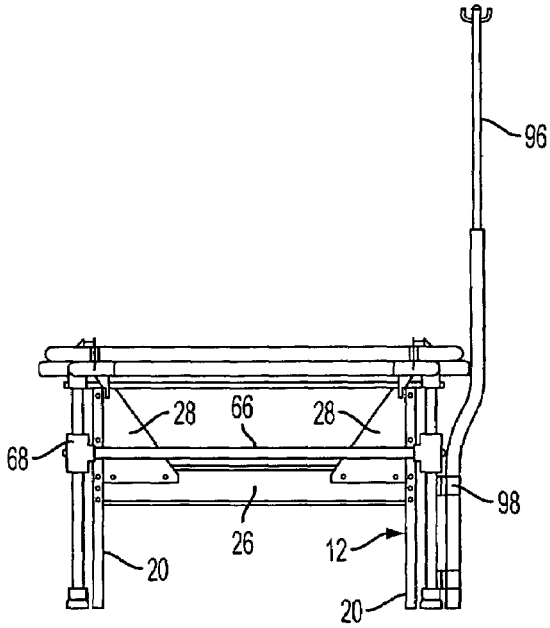
FIG. 3 is an end side view of the foldable medical bed of FIG. 2.

The slot 86 of adjustment arms 80 has a curved shape to assist in the sliding movement of the rod 64 during the raising and lowering of the sections 70 and to enable each section 70 to lie substantially horizontal as shown in FIG. 4. The slot 86 has a length to limit the sliding movement of the adjustment arm 80 with respect to rod 81 and to assist in supporting the section 70 of the adjustable frame in a horizontal position. The curved and offset portion 83 of the adjustment arms minimize interference of the arms 80 with the web material 18 when the section is in the horizontal position. As shown in FIG. 2, each adjustment arm 80 includes a manually operated knob 89 to assist the operator in lifting the adjustment arm 80 and adjusting the section 70 to the desired position. Generally, two hands are required to lift each knob simultaneously, thereby ensuring proper adjustment and engagement with the rod 90.

A flexible webbing or fabric material 18 is attached to the center base 12 and the adjustable frame 16. As shown in FIG. 2, the flexible web 18 is attached to the arms 74 and the end section 72 of each adjustable frame 70 so that the flexible web 18 substantially covers the main frame 14 when the adjustable frame is in the horizontal position.

The flexible web 18 is attached to each of the rods 32 of the center base 12 to define a center support section 94. The center support section of the web 18 has a length corresponding to the length of the center base 12. The center support section 94 remains substantially horizontal when the sections 70 of the adjustable frame 16 are elevated as shown in FIG. 1. Preferably, center support section 94 has a width and length sufficient to support a substantial portion of the patient's weight when the adjustable section 70 is elevated.

The folding bed 10 of the invention is particularly suitable as a portable medical bed which can be folded to a compact shape and easily transported. The adjustable frame sections provide head and foot sections that can be independently elevated while the center support section 94 remains substantially horizontal. In one embodiment, the pole 96 can be attached to one of the legs of the folding bed as shown in FIG. 1 to support medical equipment. Preferably, the pole 96 is removably coupled to the leg by spring clips 98.

Although a single embodiment has been chosen to illustrate the invention, it will be understood by those skilled in the art that various changes and modifications can be made without departing from the spirit and scope of the invention as defined in the appended claims.

What is claimed is:

1. A folding bed comprising:

a center base having a first support member and a second support member, said first and second support members having a longitudinal top edge;

a main support frame having a first section pivotally coupled to a first end of said first and second support members about first pivot points and a second section pivotally connected to a second end of said first and second support members about second pivot points;

an adjustable frame having a first section pivotally connected to said first section of said main support frame about third pivot points and a second section pivotally connected to said second section of said main support frame about said fourth pivot points; and a flexible support web directly attached to each of said first and second sections of said adjustable frame and directly attached to said longitudinal top edge of said first and second support members of said center base, said first and second support members forming a stationary planar center support portion of said web having a width extending between said longitudinal top edges and a length extending along said longitudinal top edges of said first and second support members.

2. The folding bed of claim 1, wherein said first pivot points of said first and second sections of said main frame are oriented adjacent first and second side edges of said center base, respectively.

3. The folding bed of claim 2, further comprising a bracket defining a stop member for limiting pivotal movement of said first and second sections of said main frame in an upward direction from a horizontal position with respect to said center base, said bracket being on a side of said first support member of said center base whereby said first and second sections of said main frame pivot downwardly from a horizontal position with respect to said center base to a folded position.

4. The folding bed of claim 1, wherein said first support member and said second support member have a width defining said stationary planar support portion of said flexible support web and a height defining a height of said bed.

5. The folding bed of claim 1, wherein said third and fourth pivot points of said first and second sections of said adjustable frame, respectively, are spaced outwardly from said first and second pivot points of said first and second sections of said main support frame wherein said first and second pivot points define a pivot axis that is spaced from a pivot axis of the pivot points.

6. The folding bed of claim 5, wherein said adjustable frame has a dimension greater than a dimension of said main frame, and wherein said first and second sections of said adjustable frame are pivotally connected at said third and fourth pivot points to an outer side edge of said main frame.

7. The folding bed of claim 3, wherein said bracket is coupled to a side surface of said first support member of the center base to define an upwardly open recess for receiving an end portion of said first and second sections of said main frame.

8. A folding bed comprising:

a center base having a first planar support member and second planar support member, each said support member having a longitudinal top edge and a longitudinal bottom having a dimension for supporting said center base in an upright position, said first and second support members being connected together by a cross member;

a main support frame assembly including a first section having one end pivotally coupled to a first side edge of said first and second planar support members and being pivotable about a first pivot axis, and a second section having one end pivotally coupled to a second side edge of said first and second planar support members and being pivotable about a second pivot axis, said first and second sections being pivotable between a horizontal position with respect to said center base to a downwardly folded position;

an adjustable frame assembly having a first section pivotally connected to said first section of said support frame at a third pivot axis spaced outwardly from said first pivot axis of said first section of said support frame, and a second section pivotally connected to said second section of said support frame at a fourth pivot axis spaced outwardly from said second pivot axis of said second section of said support frame; and a flexible support web attached directly to said longitudinal top edge of each of said first and second planar support members to form a planar center support portion of said web extending between said planar support members and having a length substantially equal to a length of said planar support members, and wherein said web is attached directly to said first section and said second section of said adjustable frame.

9. The folding bed of claim 8, wherein said adjustable frame assembly has a dimension greater than said main support frame and where said adjustable frame assembly surrounds said main support frame when in said horizontal position.

10. The folding bed of claim 9, further comprising a bracket defining a stop member on each said first and second planar support members, each said bracket defining an upwardly open channel receiving an end of each said first and second sections of said main support frame.

11. The folding bed of claim 10, further comprising a pair of support arms pivotally coupled to each said first and second sections of said adjustable frame for selectively adjusting the angular position of the respective sections of the adjustable frame, and where said first and second sections of said main support frame has a cross brace, and where said support arms include a longitudinal slot having a plurality of notches for receiving said cross brace, and wherein said support arms contact said first and second sections of said main support frame when said first and second sections of said adjustable frame are in a substantially horizontal position.

12. A folding bed comprising:

a center base having a first planar support member and a second planar support member connected together by a brace, each said support member having a longitudinal top edge and bottom with a dimension to support said center base in an upright position, and each support member having a first side edge and a second side edge;

a main support frame having a first section having a first end pivotally connected to said first and second planar support members at said respective first side edge and being pivotable about a first pivot axis in a downward direction, and a second section having a first end pivotally connected to said first and second planar support members at said respective second side edge and being pivotable in a downward direction about a second pivot axis;

an adjustable frame assembly having a first section with a first end pivotally coupled to said first section of said main support frame at a third pivot axis spaced outwardly from the first pivot axis of said first section of said main support frame, and a second section having a first end pivotally connected to said second section of said main support frame at a fourth pivot axis spaced outwardly from the second pivot axis of said second section of said main support frame;

a pair of support arms each having a first end coupled to a second end of said first and second sections of said adjustable frame and a second end portion engaging said main frame to support said first and second sections of said adjustable frame at a selected angle with respect to said main frame; and a flexible support web directly attached to said longitudinal top edge of each first and second planar support members to form a stationary planar center support portion of said web extending between said planar support members and having a length substantially equal to a length of said planar support member, and where said web is directly attached to said second end of said first and second sections of said adjustable frame.

13. The folding bed of claim 12, wherein said first and second sections of said adjustable frame are defined by a pair of parallel arms having free ends defining said first end of said first and second sections and have a cross member extending between said arms and defining said second end of said first and second sections, and where each of said support arms include an aperture at said first end of said arms and receiving said cross member of said adjustable frame.

14. The folding bed of claim 12, wherein said first and second sections of said main frame include a cross brace, and where said support arms include an adjustment slot receiving said cross brace, said adjustment slot having a plurality of notches for selectively adjusting the angular position of said first and second sections of said adjustable frame with respect to said main frame, and wherein said support arms contact said main frame when said first and second sections of said adjustable frame are in a reclined position.

15. The folding bed of claim 14, further comprising a bracket defining a stop member coupled to each of said planar support members of said center base to contact an end of each of said first and second end sections of said main support frame.

16. The folding bed of claim 15, wherein said first and second sections of said main support frame include a pair of parallel legs defining said respective first ends, and where said first pivot point is spaced from said respective ends of said parallel legs to form a first portion extending between said first pivot point and said end, and where said first portion of said first and second sections of said main support frame contact said bracket to limit pivotable movement in an upward direction and to orient said first and second sections of said main support in a substantially horizontal position.

17. The folding bed of claim 16, wherein said bracket has an upwardly open longitudinal channel having a length to receive said first portions of said first and second sections of said main support frame.

* * * * *